US007532842B2

(12) United States Patent
Handa et al.

(10) Patent No.: US 7,532,842 B2
(45) Date of Patent: May 12, 2009

(54) COLOR PRINTING APPARATUS CAPABLE OF COLOR REGISTRATION DIFFERENCE CORRECTION

(75) Inventors: Seiichi Handa, Tokyo (JP); Yasuhisa Ehara, Kamakura (JP); Joh Ebara, Kamakura (JP); Kazuhiko Kobayashi, Tokyo (JP); Toshiyuki Uchida, Kawasaki (JP); Noriaki Funamoto, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 237 days.

(21) Appl. No.: 11/560,298

(22) Filed: Nov. 15, 2006

(65) Prior Publication Data

US 2007/0110477 A1 May 17, 2007

(30) Foreign Application Priority Data

Nov. 15, 2005 (JP) ..... 2005-330310
Jul. 27, 2006 (JP) ..... 2006-204604

(51) Int. Cl.
*G03G 15/00* (2006.01)

(52) U.S. Cl. ..... 399/167

(58) Field of Classification Search ..... 399/38, 399/39, 40, 130, 159, 167, 298, 299, 301
See application file for complete search history.

(56) References Cited

U.S. PATENT DOCUMENTS 5,457,518 A * 10/1995 Ashikaga et al. ..... 399/28
6,661,986 B2 * 12/2003 Kitayama ..... 399/167
2007/0110477 A1 5/2007 Handa et al.
2008/0131166 A1 * 6/2008 Yokoyama et al. ..... 399/159

FOREIGN PATENT DOCUMENTS

JP 2005-140870 6/2005

OTHER PUBLICATIONS

U.S. Appl. No. 11/972,136, filed Jan. 10, 2008, Funamoto et al.

* cited by examiner

*Primary Examiner*—Hoan H Tran
(74) *Attorney, Agent, or Firm*—Oblon, Spivak, McClelland, Maier & Neustadt, P.C.

(57) ABSTRACT

A color printing apparatus having a color registration difference correction function, the color registration difference caused by a difference of rotation speeds of each photosensitive drum after a print mode changes from a one photosensitive drum mode to an all photosensitive drums mode.

20 Claims, 16 Drawing Sheets

COLOR PRINTING APPARATUS CAPABLE OF COLOR REGISTRATION DIFFERENCE CORRECTION

CROSS-REFERENCE TO RELATED APPLICATIONS

This patent specification is related to and claims priority under 35 U.S.C. §119 to Japanese patent application No. 2005-330310, filed on Nov. 15, 2005 and No. 2006-204604, filed on Jul. 27, 2006, in the Japanese Patent Office, the entire contents of each of which are hereby incorporated herein by reference.

BACKGROUND OF THE INVENTION

1. Field of the Invention

This invention relates to a color registration correction in an image forming process for a color printing apparatus having a plurality of photosensitive drums. The images are formed toner images of each color and the toner images of each color are transferred directly to a recording sheet or to an intermediate transfer medium then transferred again to the recording sheet from the intermediate transfer medium. This invention avoids the color registration correction caused by fluctuation between rotation speeds of the plurality of photosensitive drums.

2. Description of the Background Art

The color printing apparatus having above mentioned structures, in which a plurality of photosensitive drums are arranged in line, is called a tandem type apparatus. In the tandem type color printing apparatus, each photosensitive drum has a drum gear and a motor rotates the drum gear. The rotation of the drum gear causes the rotation of the photosensitive drum and a toner image is formed on the photosensitive drum.

In the image forming process of the tandem type color printing apparatus, the fluctuation between the rotation speeds of the photosensitive drums causes a color registration difference on the recording sheet or the intermediate transfer medium. The causes of the fluctuation between the rotation speeds are an eccentricity of the drum gear and the photosensitive drum, and an eccentricity of a rotation axis of the drum gear and the photosensitive drum. Accordingly, the fluctuation between the rotation speeds changes periodically, as shown in FIG. 1.

To minimize the color registration difference, in the color printing apparatus disclosed in Japanese laid-open patent 2005-140870, line patterns of each color that have predetermined pitch are formed around the photosensitive drums of each color, and the toner images based on the line patterns are transferred to the recording sheet or the intermediate medium. A sensor detects the transferred toner images, and the position difference between the transferred toner images of each color are calculated based on an output signal of the sensor. Based on the calculated position difference, a relationship of a rotation start position of each photosensitive drum is decided. Maintaining the relationship of rotation start positions minimizes the color registration difference.

Shown in upper portion of FIG. 1, the difference of the speed of each photosensitive drum causes the color registration difference. To control a rotation start position of each photosensitive drum reduces the difference of the color registration shown in lower portion of FIG. 1.

Usually, the above mentioned color printing apparatus has two print modes. One is a black and white mode, which uses only the photosensitive drum for black toner to print a black and white image, and the other is a color print mode, which uses all photosensitive drums to print a color image. In the color print mode, the rotation start positions of all photosensitive drums are controlled to satisfy the relationship shown in the lower portion of FIG. 1. In the black and white mode, only the photosensitive drum for black image is rotated to form a black toner image. After finishing forming the black toner image, the start position of the black photosensitive drum is not controlled. Therefore the start position of the black photosensitive drum does not satisfy the relationship shown in the lower portion of FIG. 1, and the rotation start position needs to be adjusted before starting the next printing.

SUMMARY OF THE INVENTION

In light of recognition of the above described problem, the present inventors invented a color printing apparatus having an improved color registration correction. For example, the color printing apparatus includes a plurality of photosensitive drums, a plurality of motors that rotates the photosensitive drums, an image forming unit that forms an image with one or all of photosensitive drums, a print mode setting unit that select the print mode for the image forming unit, and a controller that controls turning the motors on and off. When the print mode changes from image forming with one photosensitive drum to image forming with all photosensitive drums, the controller controls rotation start timings for the photosensitive drums, which stop in the one photosensitive drum mode, corresponding to a position of the photosensitive drum, which rotates in the one photosensitive drum mode.

BRIEF DESCRIPTION OF THE DRAWINGS

In order that the invention may be more clearly understood, it will now be disclosed in greater detail with reference to the accompanying drawings, wherein.

DETAILED DISCLOSURE OF EXAMPLE EMBODIMENTS

Figure 2:
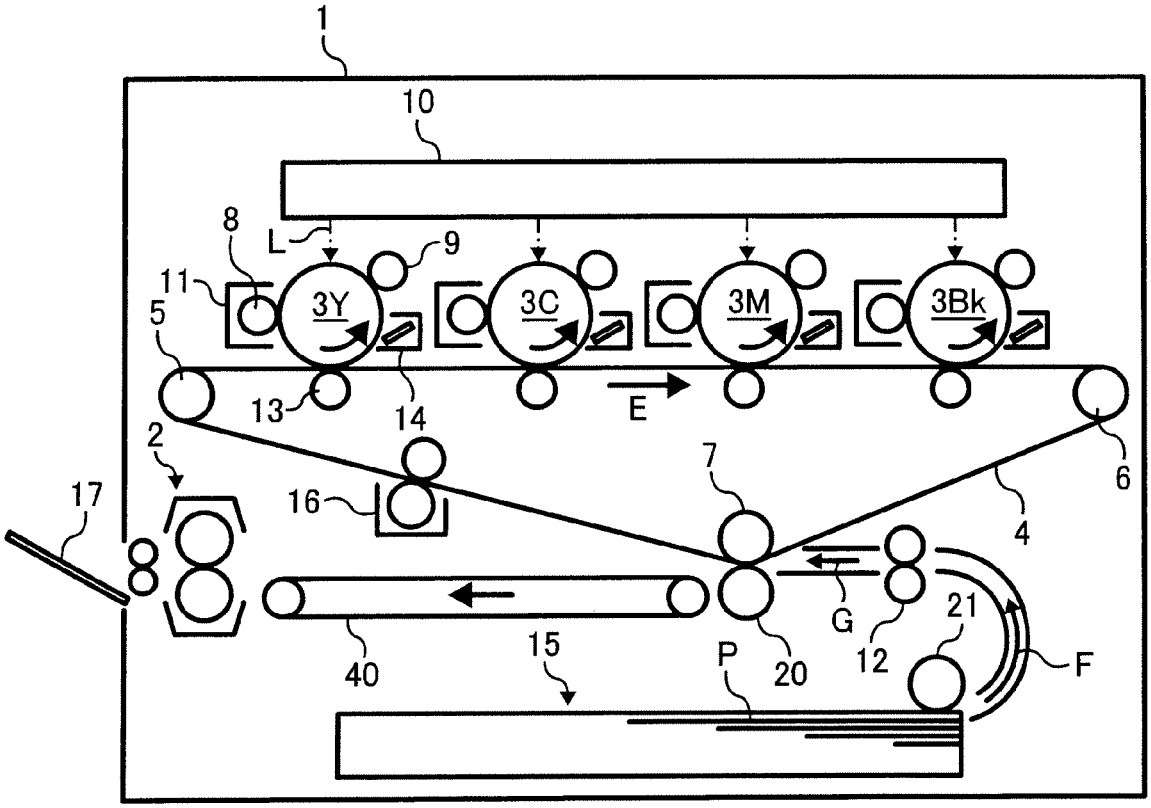
FIG. 2 is a perspective view illustrating a structure with main parts of the color printing apparatus.

Referring to FIG. 2, a color printing apparatus 1 is explained. As illustrated in FIG. 2, the color printing apparatus 1 includes a plurality of photosensitive drums 3Y (Yellow), 3C (Cyan), 3M (Magenta), and 3Bk (Black) and a toner image corresponding each color is formed on each photosensitive drum 3Y, 3C, 3M, and 3Bk. All photosensitive drums 3Y, 3C, 3M, and 3Bk are aligned in parallel with a transfer belt 4 and rollers 5, 6, and 7 support the transfer belt 4. And at least one of the rollers 5, 6, and 7 rotates the transfer belt 4 in the direction of the arrow "E" shown in FIG. 2.

As an image forming process for each color is same, explanations are made based on the image forming process for the yellow color. The photosensitive drum 3Y is rotated counter-clockwise by a driving motor 29Y (Shown in FIG. 3). A charging unit 9 charges a surface of the photosensitive drum 29Y. An exposing unit 10 emits a laser beam L which scans the surface of the photosensitive drum 3Y and forms an electrical latent image corresponding to the yellow image on the photosensitive drum 3Y. The electrical latent image is developed by yellow toner held on a developing roller 8 of a developing unit 11 and becomes the yellow toner image. After the toner image on the photosensitive drum 3Y is transferred by a transfer roller 13, the residual toner on the photosensitive drum 3Y is cleaned by a cleaning unit 14.

A similar image forming process occurs on the other photosensitive drums 3C, 3M, and 3Bk. Toner images corresponding to cyan, magenta, and black are sequentially transferred to the transfer belt 4 and a color toner image is formed on the transfer belt 4 in a color print mode. In a black and white print mode, only the black toner image, which is formed on the photosensitive drum 3Bk, is transferred to the transfer belt 4.

A transfer roller 20, which is located an opposite side of the transfer belt 4 and faces the roller 7, transfers the color toner image to a recording sheet P. The recording sheet P is fed from a sheet tray 15 along the direction of an arrow "F" by pickup roller 21. A registration roller pair 12 sends the recording sheet P between the roller 7 (the transfer belt 4) and the transfer roller 20 along the direction of an arrow "G." After transferring the color toner image to the recording sheet P, residual toners are removed from the transfer belt 4 by a cleaning unit 16.

A conveying unit 40 carries the recording sheet P, which has the color toner image on it, to a fusing unit 2. The fusing unit 2 applies heat and pressure to the recording sheet P and fixes the toner image on the recording sheet. After the toner image is fixed to the recording sheet P, the recording sheet P is discharged to a tray 17.

Figure 3:
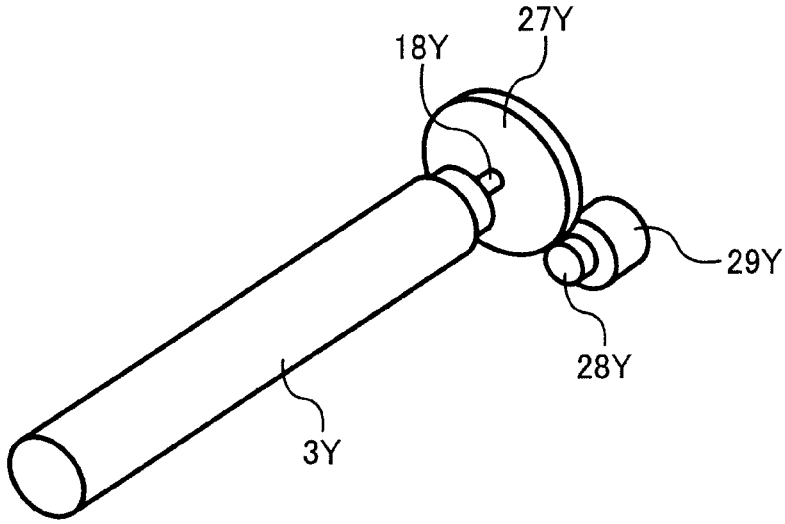
FIG. 3 shows a photosensitive drum and a structure of a driving mechanism for the photosensitive drum shown in FIG. 1.

FIG. 3 shows the photosensitive drum 3Y and a driving mechanism for the photosensitive drum 3Y. The photosensitive drum 3Y is supported at one end of a rotating axis 18Y, and a drum gear 27Y is attached at the other end of the rotating axis 18Y. The centers of the photosensitive drum 3Y, the rotating axis 18Y and the drum gear 27Y are aligned. The drum gear 27Y is rotated by a motor gear 28Y, which is powered by a motor 29Y.

Figure 4:
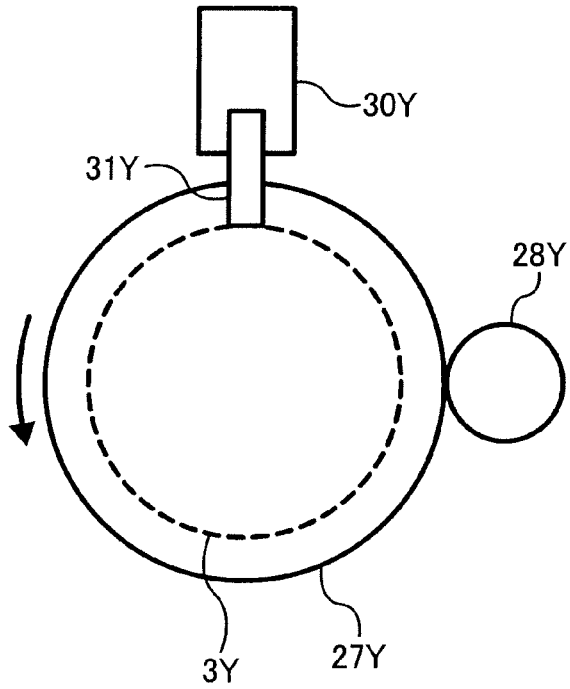
FIG. 4 shows a position relationship between a filler, which is on a rim of a drum gear, and a sensor, which detects the filler.

FIG. 4 shows a filler 31Y, which is fixed on a rim of the drum gear 27Y, and a sensor 30Y, which detects the filler 31Y. The filler 31Y and the sensor 30Y operate as a home position detector of the photosensitive drum 3Y. An angular position between the filler 31Y and the sensor 30Y shown in FIG. 4 is achieved by stopping the motor 29Y immediately after the sensor 30Y detects the filler 31Y. The rotating position shown in FIG. 4 is a home position of a rotation. As the filler 31Y is attached to the rim of the drum gear 27Y, so the filler 31Y also rotates counter-clockwise direction along with the rotation of the drum gear 27Y.

Figure 5:
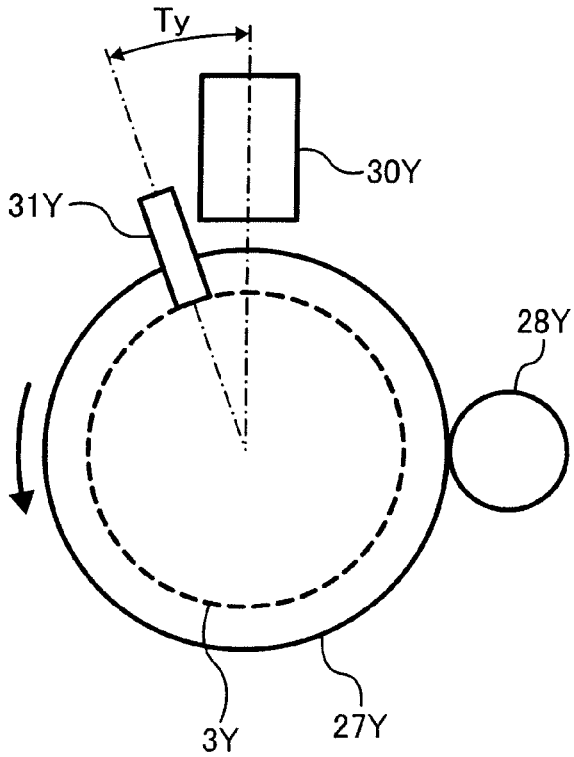
FIG. 5 shows a position relationship between a filler and a sensor, in case a motor is stopped after a time Ty from a time when the sensor detects the filler.

FIG. 5 shows the relationship of the position between the filler 31Y and the sensor 30Y which is achieved by stopping the motor 29Y a time Ty after the sensor 30Y detects the filler 31Y. Accordingly, controlling the time Ty can control the rotating position of the photosensitive drum 3Y. In one embodiment of the invention, the rotating positions and rotation start timings of each photosensitive drums 3Y, 3C, 3M and 3Bk are controlled to decrease color registration differences between each color which could occur when the print mode is changed from the black and white mode to the color mode.

Figure 6:
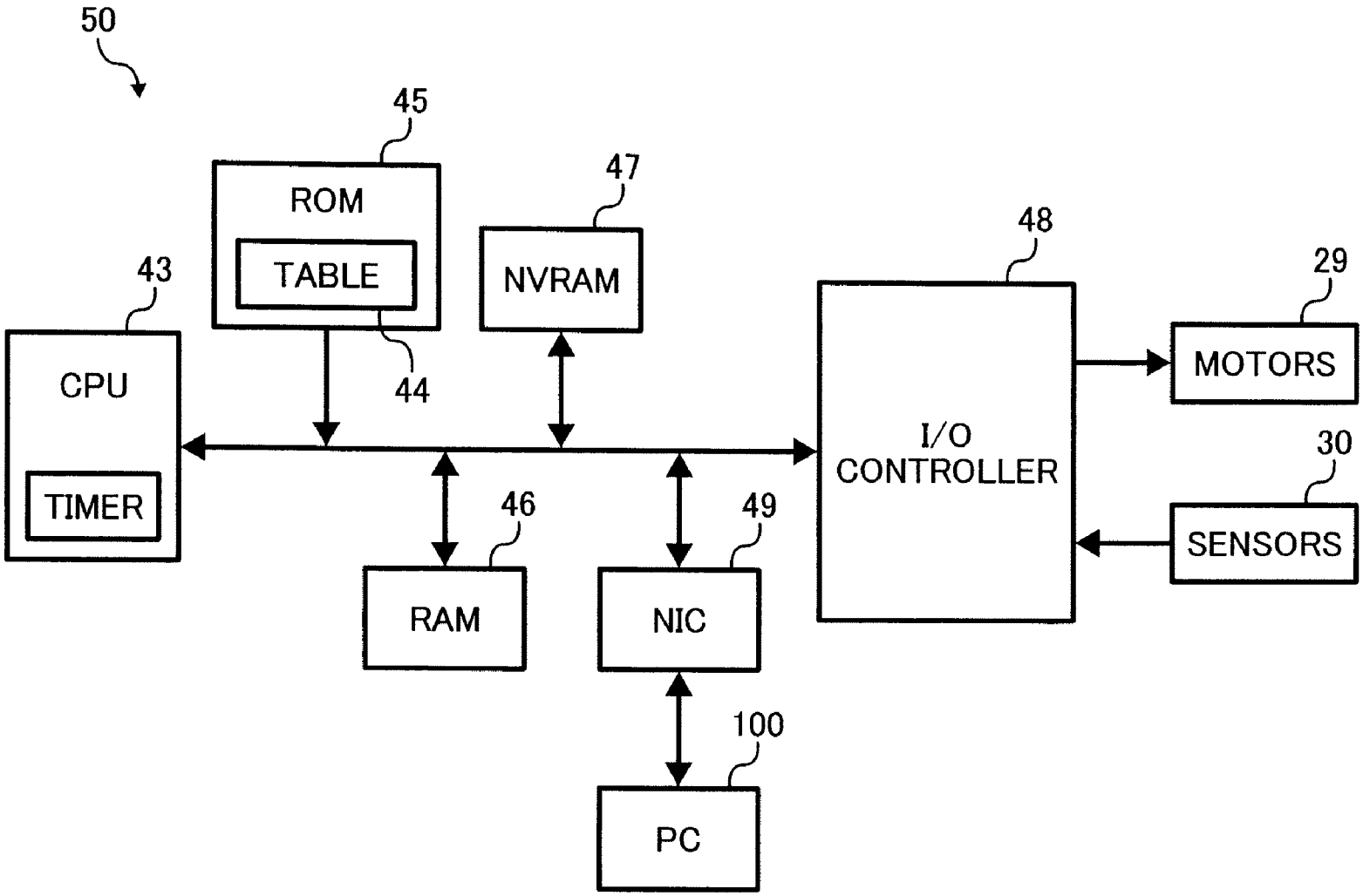
FIG. 6 is a block diagram illustrating a controller for a color registration correction.

FIG. 6 shows a block diagram of a controller 50, which provides a registration correction control of the apparatus mentioned below. The controller 50 is provided with a CPU 43, a ROM 45, which stores a program for the registration correction control of the apparatus, a RAM 46, which is used as a work area for the CPU 43, an I/O controller 48, which controls the motors 29Y, 29C, 29M and 29Bk based on detection results from the sensors 30Y, 30C, 30M and 30Bk, and a network control interface (NIC) 49, which allows the color printing apparatus 1 to communicate with an external PC 100. The color printing apparatus 1 receives image data to print and a print mode command to indicate the black and white print mode or the color print mode from the external PC 100 through the NIC 49. The external PC 100 may set the print mode command for each printing page. The ROM 45 also stores a table 44 for determining an offset time, as described later. The CPU 43 has a timer function and measures time using that timer function.

Figure 1:
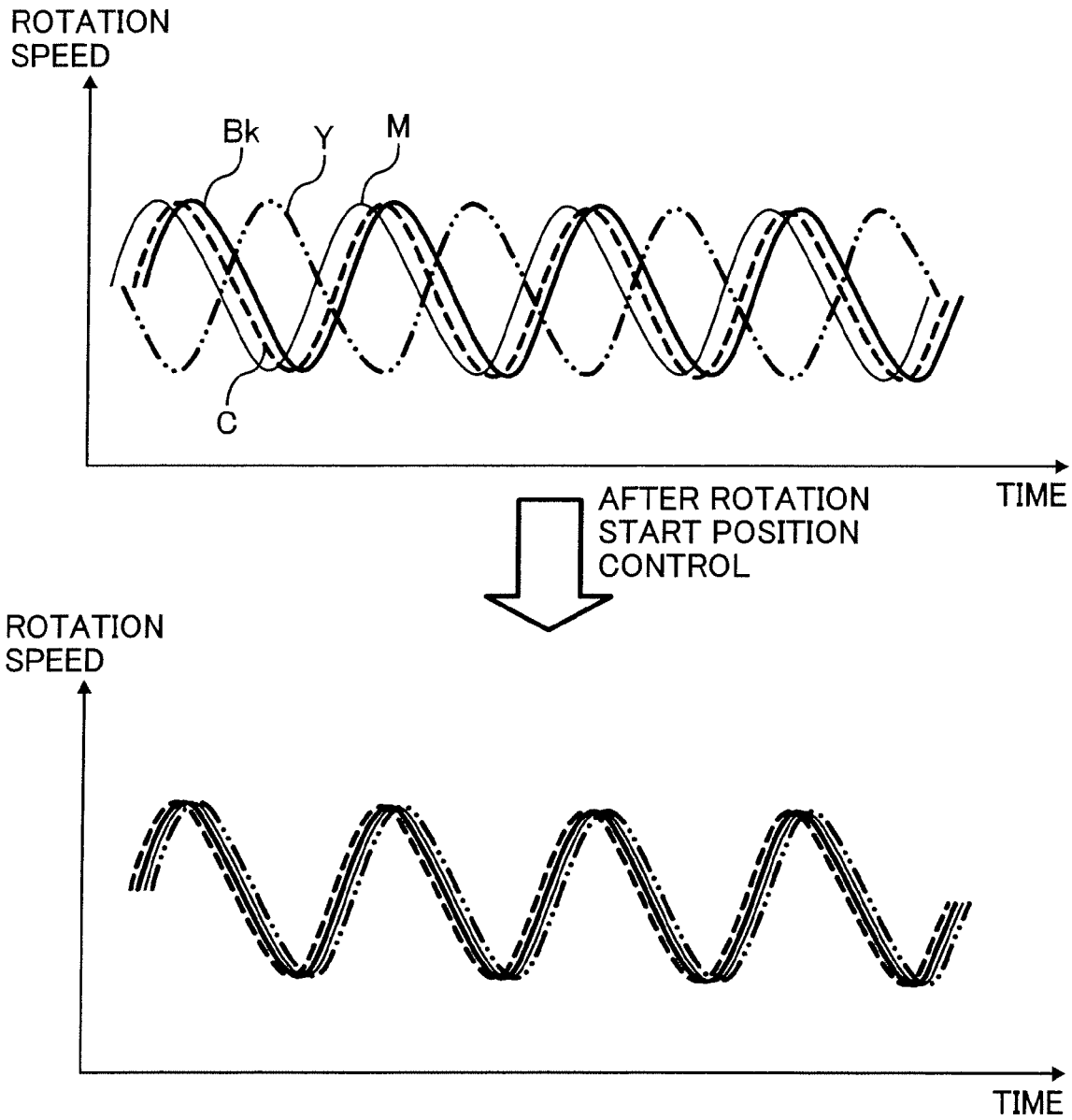
FIG. 1 illustrates a color registration difference caused by a difference in speed of each photosensitive drum and a decrease of the color registration difference by controlling a rotation start position.
Figure 7:
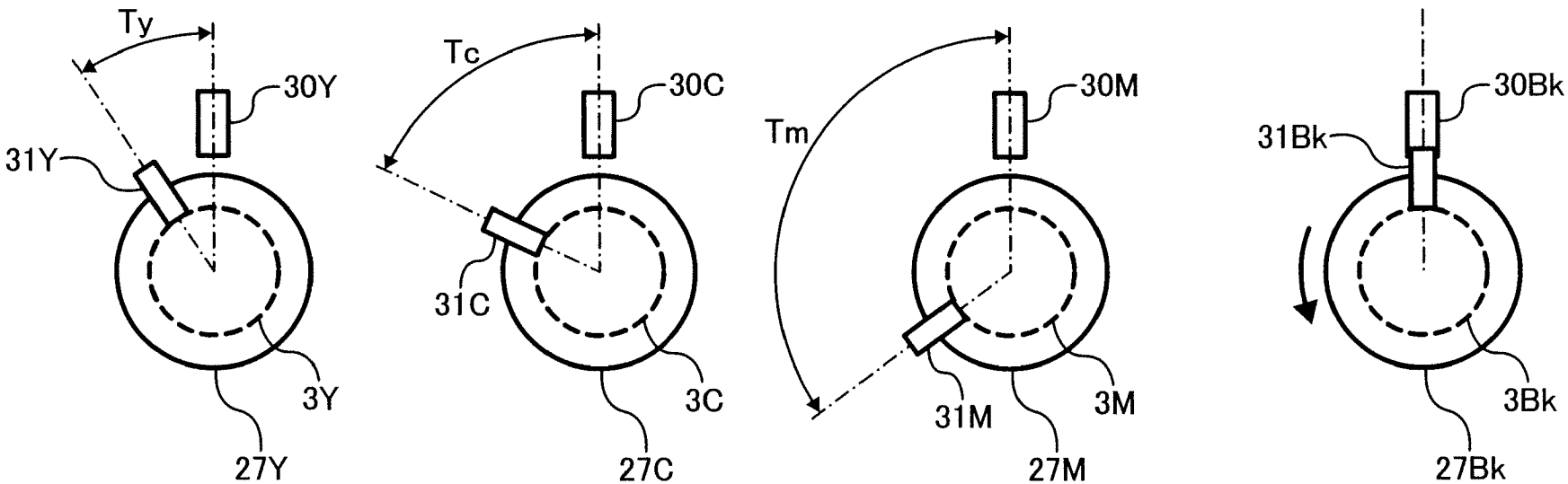
FIG.7 illustrates a relationship of rotation start positions of each photosensitive drum in one embodiment.
Figure 8:
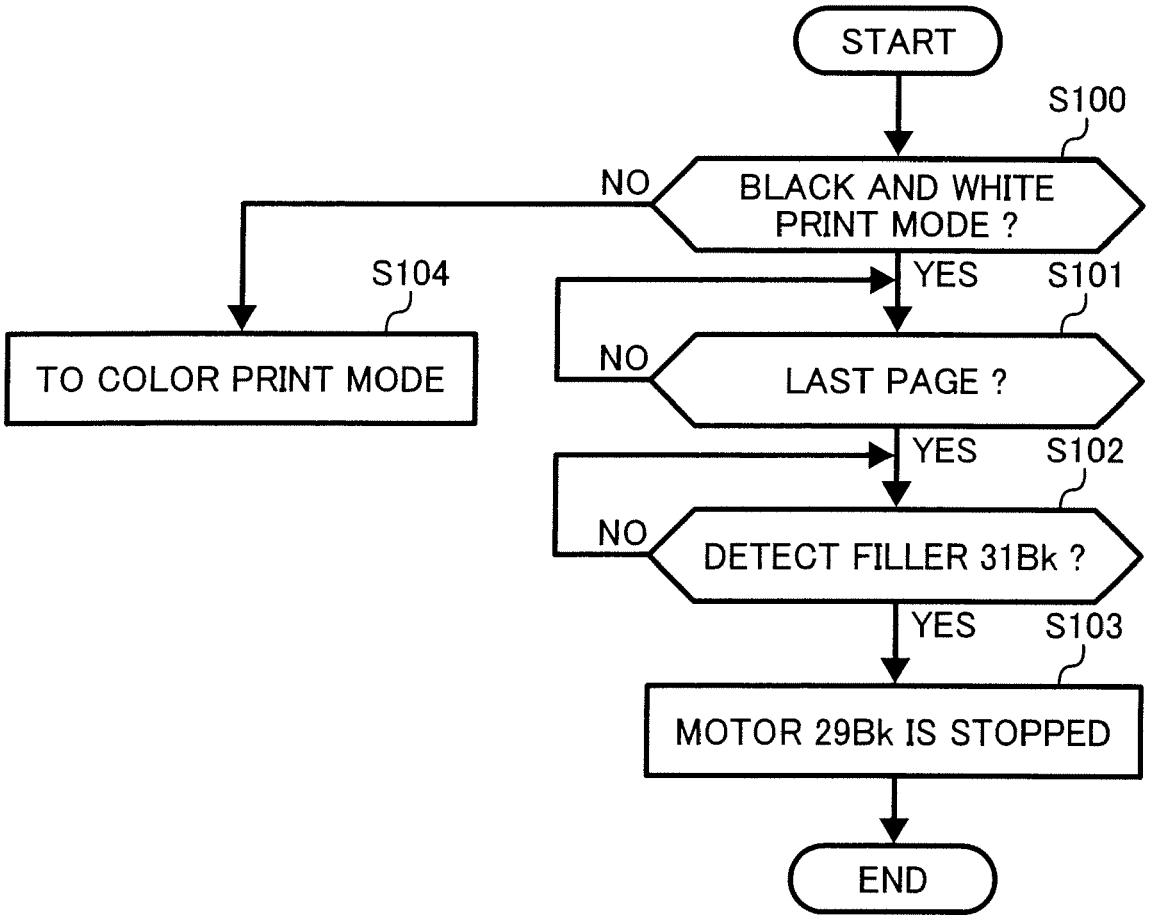
FIG. 8 is a flow chart illustrating a first embodiment of a color registration correction.

FIG. 7 shows the relationships between the rotation start positions of each photosensitive drum 3 which satisfy the relationship shown in FIG. 1. FIG. 8 is a flow chart for this embodiment. In the color print mode, the relationship between the rotation start positions of the photosensitive drums 3 is maintained to satisfy the relationship shown in FIG. 7. However, in the black and white print mode, only the photosensitive drum 3Bk rotates counter clockwise while other photosensitive drums 3Y, 3C and 3M are stopped. Accordingly, the photosensitive drum 3Y, 3C and 3M stop at the position at the offset times Ty, Tc and Tm. The offset times Ty, Tc and Tm are stored in the NVRAM 47. To satisfy the relationship shown in FIG. 7, in this embodiment, the stop position of the photosensitive drum 3Bk is controlled.

First, the CPU 43 determines the print mode based on the print mode command from the external PC 100 (S100). If the print mode is not the black and white print mode, then the registration correction control for the color print mode shown in another embodiment will be done. However, if the print mode is the black and white print mode, then the CPU 43 determines whether a printing page is the last page or not (S101). If the printing page is the last page, then the CPU 43 determines if the sensor 30Bk detects the filler 31Bk or not. If the sensor 30Bk detects the filler 31Bk (S102) then the CPU 43 immediately stops the motor 29Bk (S103).

In this embodiment, the rotation stop position of the photosensitive drum 3Bk is controlled to satisfy the relationship shown in FIG. 7. Therefore, even if the following print job is a color print mode, there is no need to adjust the rotation start position of the photosensitive drum 3Bk and printing is able to start immediately.

Figure 9:
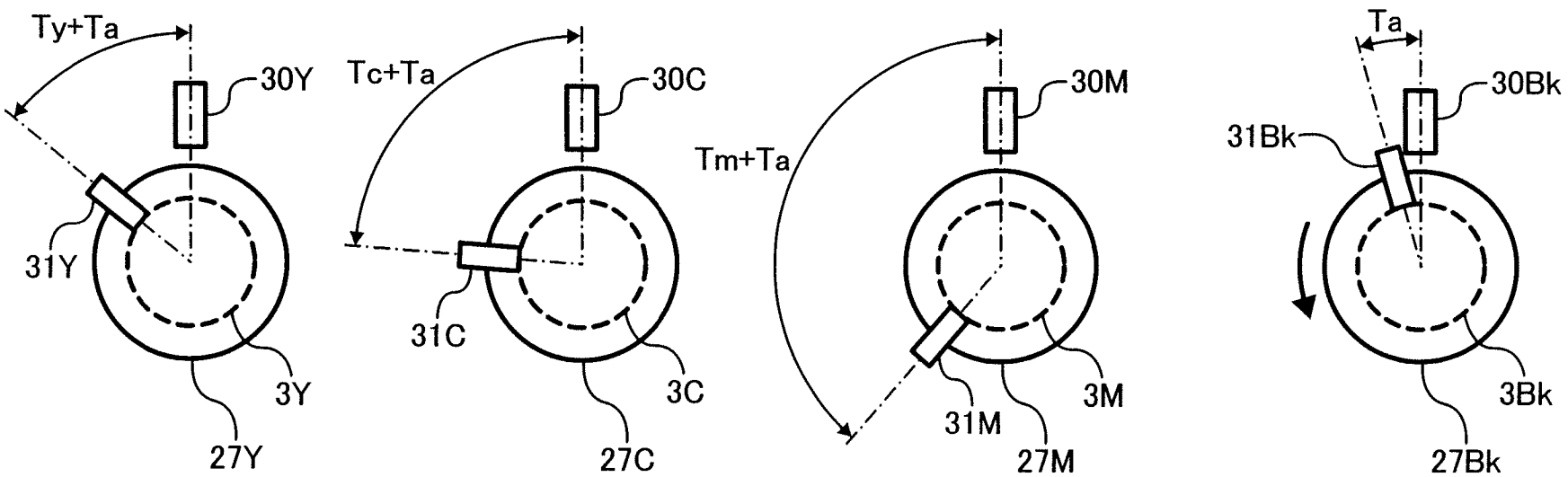
FIG. 9 illustrates a relationship of rotation start positions of each photosensitive drum in another embodiment.
Figure 10:
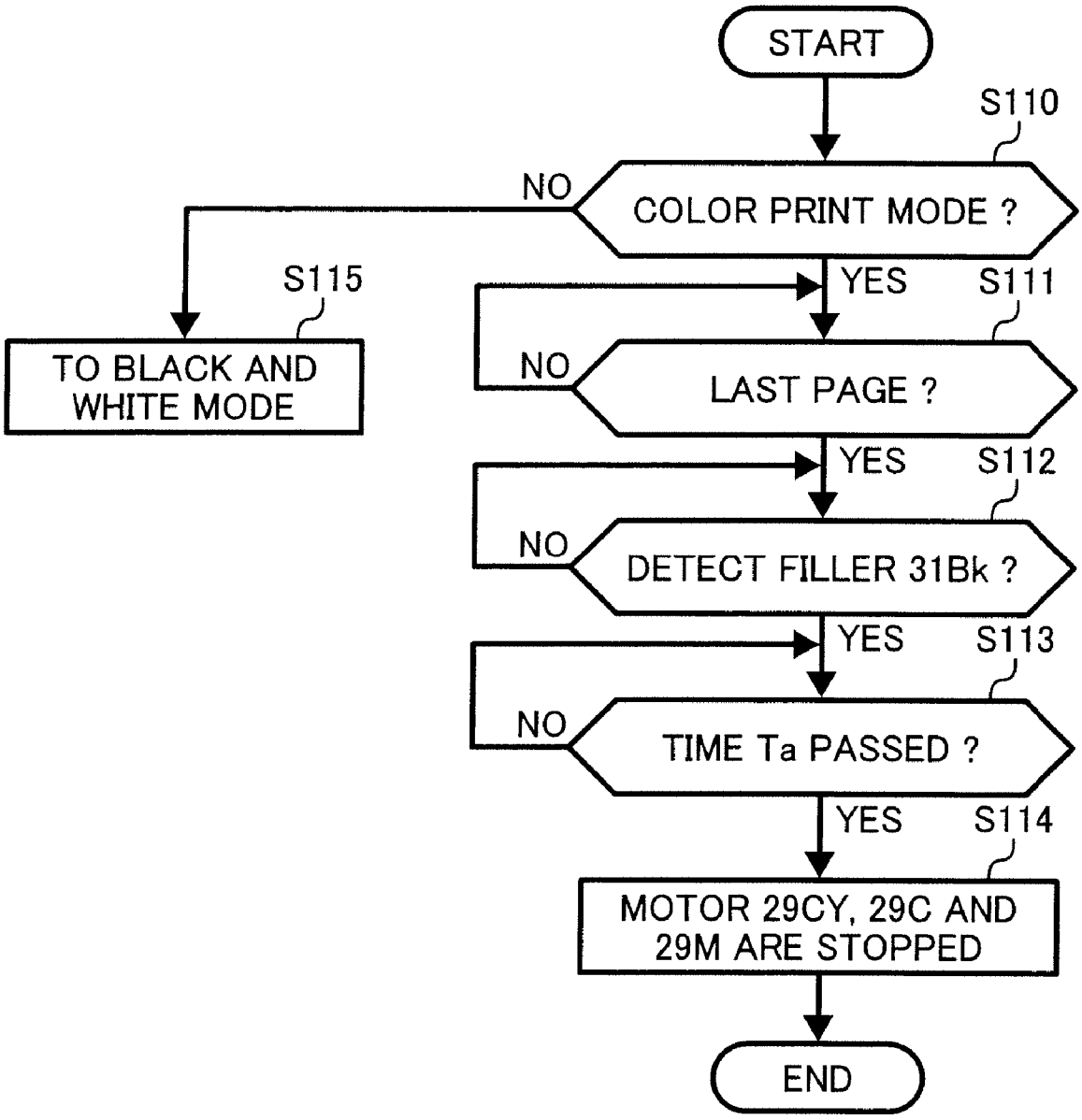
FIG. 10 is a flow chart illustrating a second embodiment of a color registration correction.

FIG. 9 shows the relationship of the rotation start positions of each photosensitive drum 3 which satisfy the relationship shown in FIG. 1, but are different from FIG. 7. FIG. 10 is a flow chart for this embodiment. If the rotation start position is kept constant, as shown in FIG. 7, then image forming process also constantly starts from same place. This causes an abrasion of the photosensitive drums 3 and causes possible image degradation. In this embodiment, therefore, the rotation stop positions of photosensitive drums 3 are changed every time after finishing the color print mode. Thus, the image forming process starts from different a rotation start position and decrease the abrasion of the photosensitive drums 3. In FIG. 9, the rotation start positions of all photosensitive drums 3 achieve a same angle (equivalent of time Ta), but satisfy with the relationship shown in FIG. 1.

First, the CPU 43 determines the print mode based on the print mode command from the external PC 100 (S110). If the print mode is not the color mode, then the registration correction control for the black and white print mode shown in another embodiment will be done. However, if the print mode is the color print mode, then the CPU 43 determines if a printing page is the last page or not (S111). If the printing page is the last page, then the CPU 43 determines if the sensors 30Y, 30C, 30M and 30Bk detect the fillers 31Y, 31C, 31M and 31Bk, respectively. If the sensors 30Y, 30C, 30M and 30Bk detect the fillers 31Y, 31C, 31M and 31Bk, respectively (S112), then the CPU 43 sets the timers for each color and determines the offset time for each photosensitive drums 3, plus a predetermined time after the detections of each sensors 30 (S113). If the offset time plus predetermined time passes, then the CPU 43 stops the motors 29Y, 29C, 29M and 29Bk (S114). Controlling the predetermined time to, for example, increase 100 ms more each time, the abrasion of the photosensitive drums 3 is decreased while satisfying the relationship shown in FIG. 1.

Figure 11A:
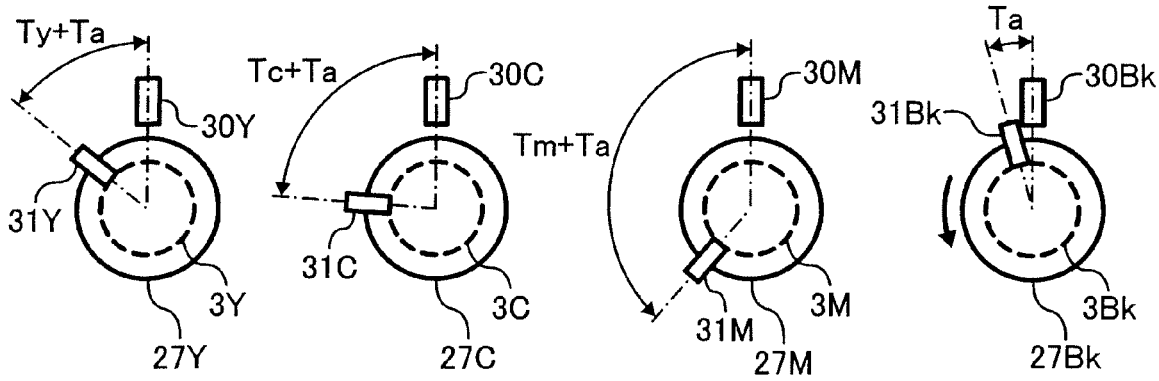
FIG. 11A explains a relationship of rotation start positions of each photosensitive drum in the other embodiment.
Figure 11B:
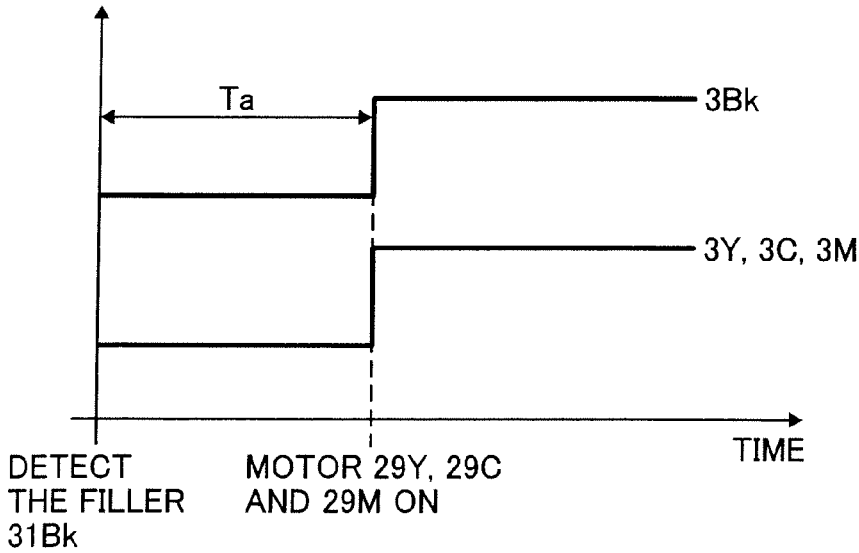
FIG. 11B is a timing chart showing rotation start timings for a black photosensitive drum and for other photosensitive drums.
Figure 12:
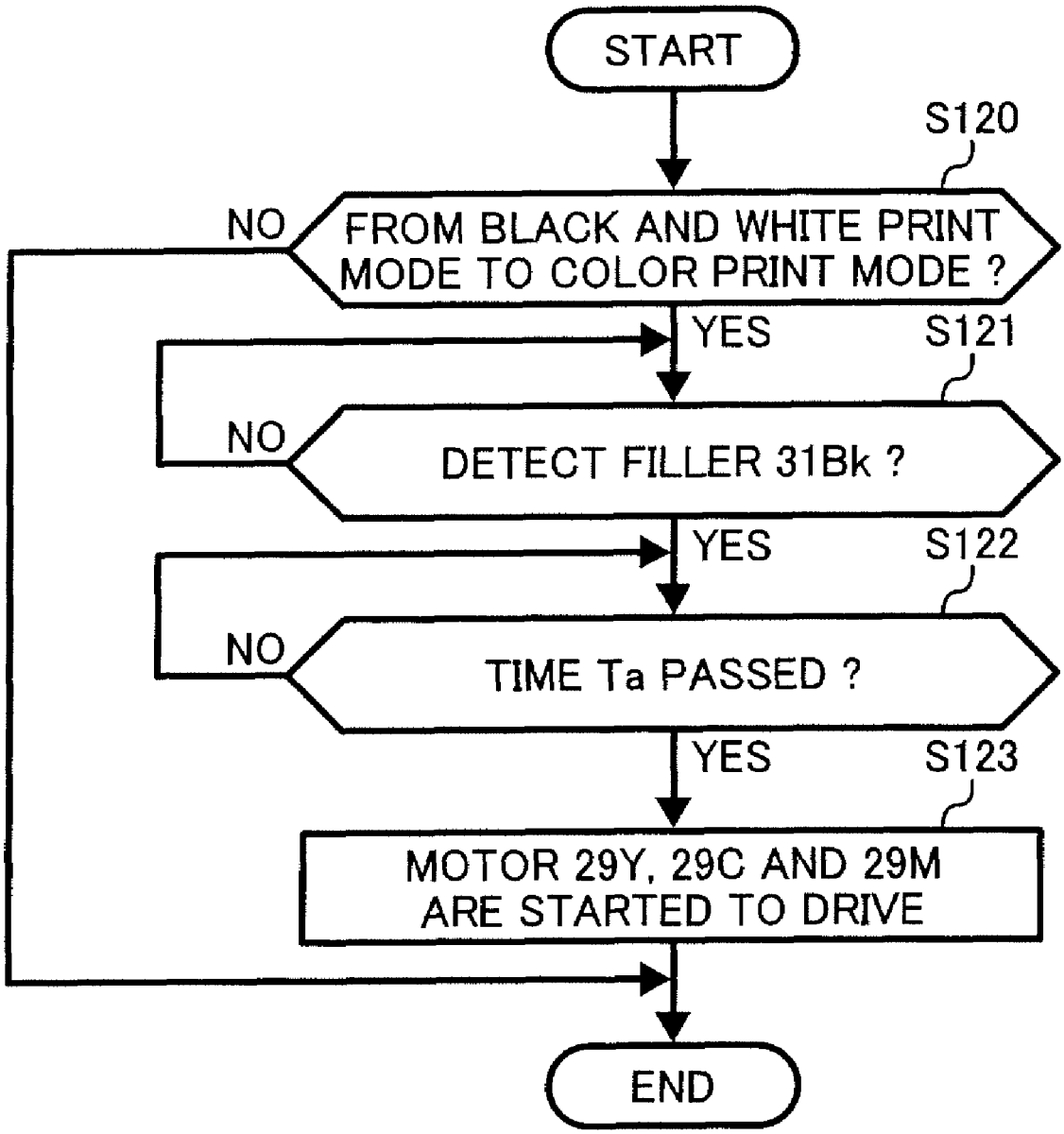
FIG. 12 is a flow chart illustrating a third embodiment of a color registration correction.

FIG. 11A shows the relationship of the rotation start position of each photosensitive drum 3 which satisfy the relationship shown in FIG. 1. FIG. 11B shows rotation start timings of the photosensitive drums 3Y, 3C and 3M. FIG. 12 is a flow chart for this embodiment. In the previous embodiment, when the print mode changes from the black and white print mode to the color print mode, the photosensitive drum 3Bk is stopped at the end of the black and white print mode, and the stop position is controlled to satisfy the relationship shown in FIG. 1. After that, all the photosensitive drums 3 are started to rotate at a same time in the color print mode. In this embodiment, during the black and white print mode, the photosensitive drums 3Y, 3C and 3M are stopped as shown in FIG. 11A. If the color print mode starts after the black and white print mode, the motors 29Y, 29C and 29M are turned on after a time Ta passes from the detection of the filler 31Bk by the sensor 30Bk. In this embodiment, the photosensitive drum 3Bk is not stopped and rotates continuously. Therefore, a transition from the black and white print mode to the color print mode occurs more smoothly.

First, the CPU 43 determines the print mode change for plural print jobs or for plural pages in one print job based on the print mode command from the external PC 100. If the print mode changes from the black and white print mode to the color print mode (S120), then the CPU 43 determines if the sensor 30Bk detects the filler 31Bk (S121)). If the sensor 31Bk detects the filler 31Bk, then the CPU 43 sets the timer and determines if the predetermined time Ta has passed after the detection of filler 31Bk (S122). If the predetermined time Ta has passed, then the CPU 43 turns on the motors 29Y, 29C, 29M (S123).

Figure 13:
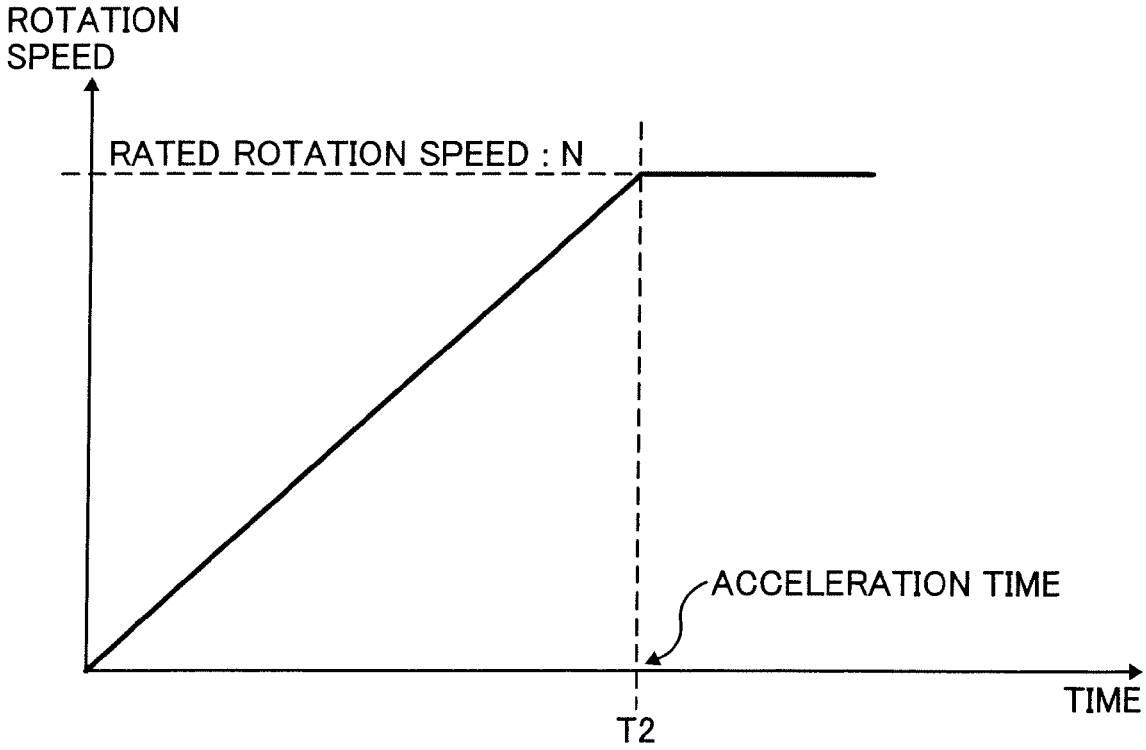
FIG. 13 is an acceleration chart explaining a relationship between a rotation speed and a time.
Figure 14:
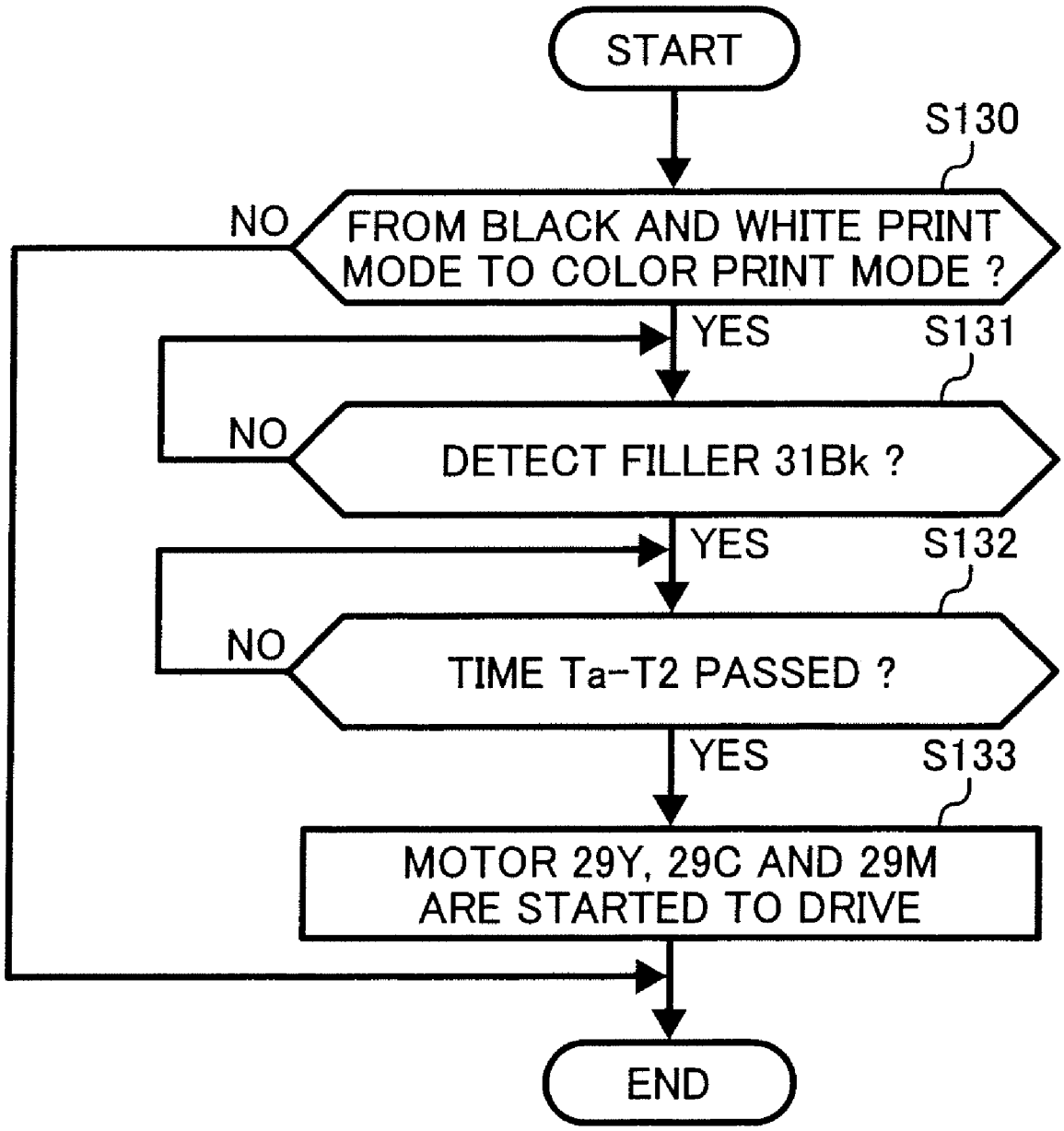
FIG. 14 is a flow chart illustrating a fourth embodiment of a color registration correction.

FIG. 13 shows an example of acceleration characteristic of the photosensitive drums 3Y, 3C and 3M. FIG. 14 is a flow chart for this embodiment. In the previous embodiment, an acceleration time of the photosensitive drums 3Y, 3C and 3M is not considered. However, as shown in FIG. 13, the photosensitive drums 3Y, 3C and 3M need the acceleration time T2 to rotate at a rated speed. The rotation start timing of the photosensitive drums 3Y, 3C and 3M is delayed from the rotation start timing of the photosensitive drum 3Bk by time T2. Therefore, the rotation start timing of the photosensitive drums 3Y, 3C and 3M becomes (Ty+Ta−T2), (Tc+Ta−T2) and (Tm+Ta−T2). In this embodiment, considering the problem of the previous embodiment, the motors 29Y, 29C and 29M are started to rotate a time T2 earlier than in the previous embodiment. Therefore, the motors 29Y, 29C and 29M are turned on when a time (Ta−T2), instead of T2 in the previous embodiment, passes from the detection of the filler 31Bk by the sensor 30Bk. In this embodiment, the acceleration time T2 is set by an operational panel (not shown) and stored in the NVRAM 47. Adjusting the rotation start timings of the photosensitive drums 3Y, 3C and 3M reduces the color registration difference.

First, the CPU 43 determines the print mode change for plural print jobs or plural pages in one print job based on the print mode command from the external PC 100. If the print mode changes from the black and white print mode to the color print mode (S130), then the CPU 43 determines if the sensor 30Bk detects the filler 31Bk (S131)). If the sensor 31Bk detects the filler 31Bk, then the CPU 43 sets the timer and determines if the offset time minus the acceleration time (Ta−T2) has passed after the detection of filler 31Bk (S132). If the time (Ta−T2) has passed, then the CPU 43 turns on the motors 29Y, 29C and 29M (S133).

The color registration correction in this embodiment prevents the color registration difference caused by the acceleration time of the photosensitive drums 3Y, 3C and 3M.

Figure 15:
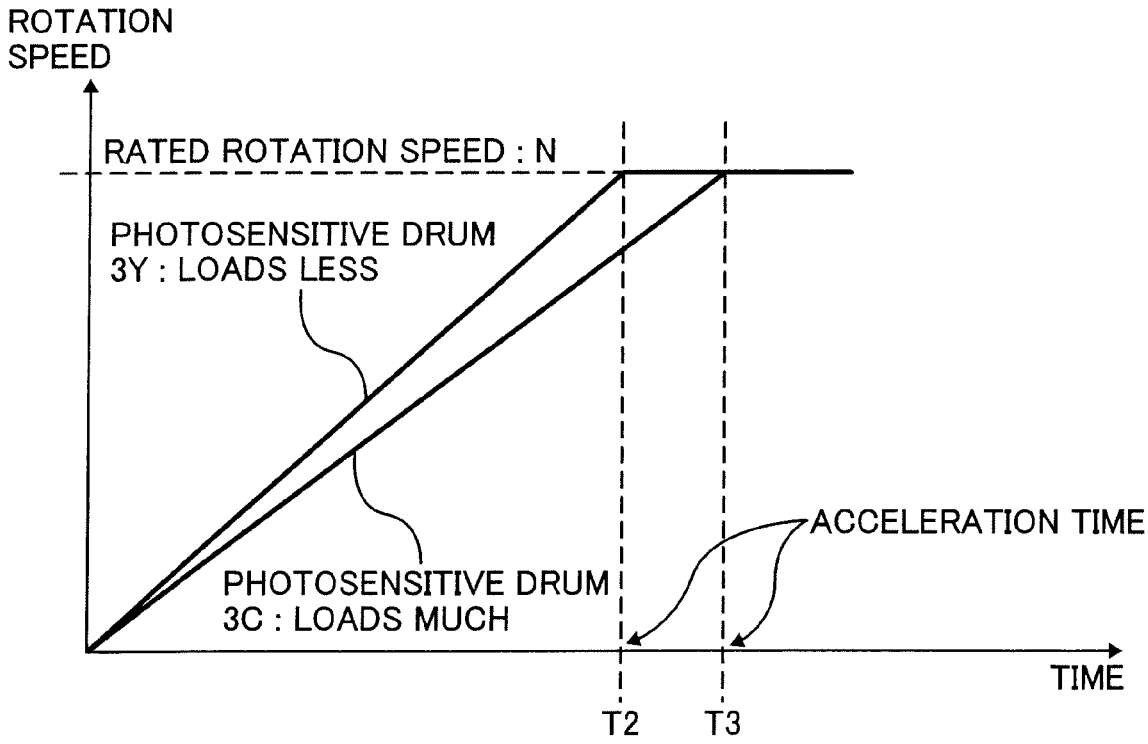
FIG. 15 is an acceleration chart explaining a difference of time to increase rotation speed to a rated rotation speed caused by a difference of load to a yellow photosensitive drum and a cyan photosensitive drum.
Figure 16A:
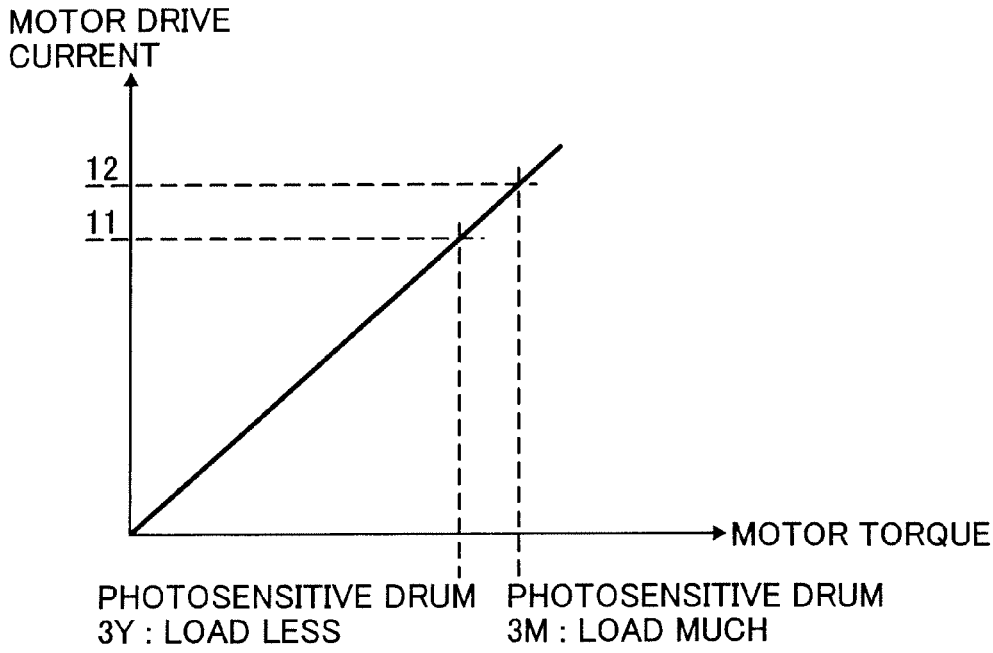
FIG. 16A is a graph explaining relationship between a drive current for a motor for photosensitive drums and a load for the motor.
Figure 16B:
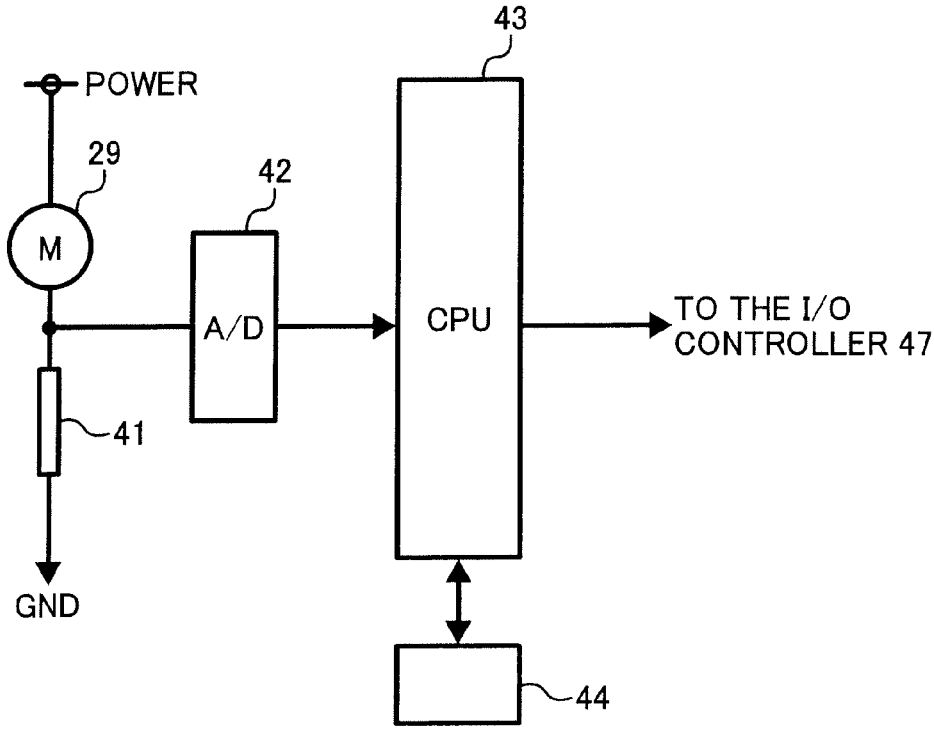
FIG. 16B is a block diagram illustrating a controller which controls a rotation start timing based on a drive current for a motor.
Figure 17:
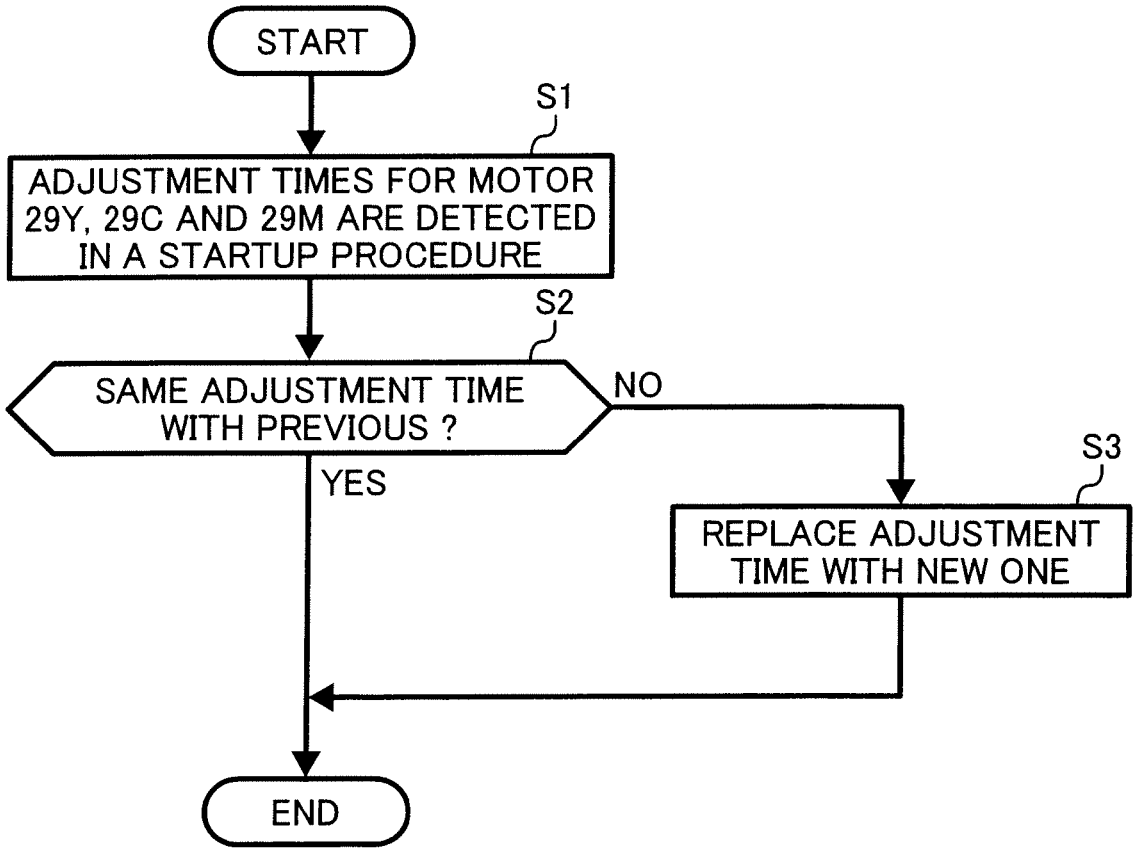
FIG. 17 is a flow chart illustrating a detection of load for a motor.
Figure 18:
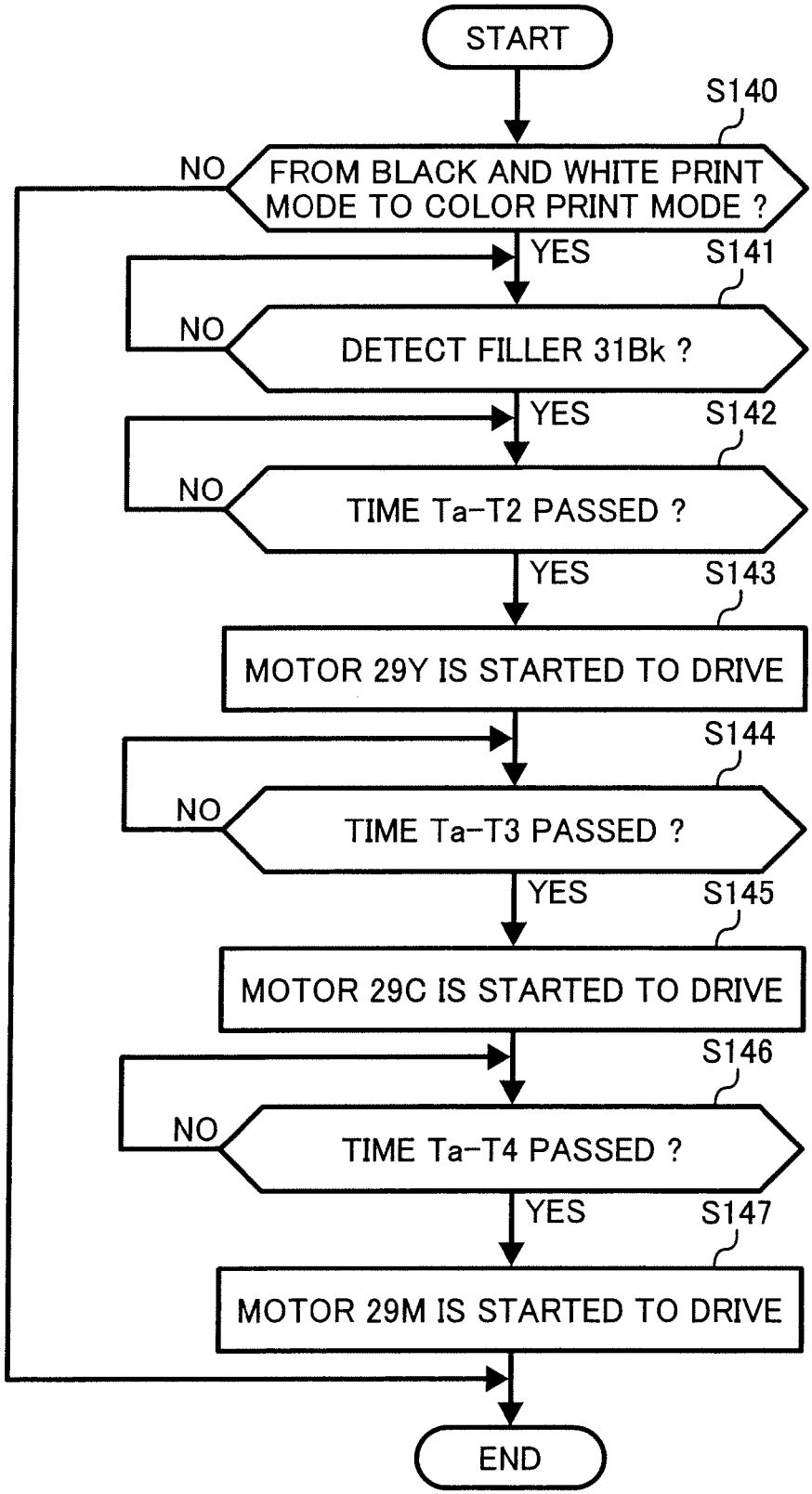
FIG. 18 is a flow chart illustrating a fifth embodiment of a color registration correction.

FIG. 15 shows an example of a difference of the acceleration characteristics of the photosensitive drums 3Y and 3C. FIG. 16A is a graph explaining a current-torque characteristic of the motors 29Y and 29C. FIG. 16B is a block diagram of a controlling block, which detects the torque of motors 29 based on the drive current and controls the rotation start timing of motors 29. FIG. 17 is a flow chart for detecting a motor load. FIG. 18 is a flow chart for the color correction process for this embodiment.

In the previous embodiment, the acceleration time for all photosensitive drums 3Y, 3C and 3M is supposed to be the same, but mechanical loads for each photosensitive drums 3 are different. Thus, the acceleration times for each photosensitive drum 3 are also different. For example, in FIG. 15, the acceleration time for the photosensitive drum 3Y, which has a lighter mechanical load, becomes time T2, but the acceleration time for the photosensitive drum 3M, which has heavier mechanical load, becomes time T3. Therefore applying the same acceleration time as in the previous embodiment still causes a slight color registration difference.

As shown in FIG. 16A, the relationship between a motor drive current and a motor torque is proportional. Therefore, detecting the motor drive current means detecting the motor loads. In FIG. 16B, the drive current of the motor 29 is converted to a voltage difference by a resistor 41. An analog to digital converter 42 converts the voltage difference of the resistor 41 to digital data, which indicate the load of the photosensitive drums 3, and sends the data to the CPU 43. The CPU 43 determines the rotation start timing by referring to the table 44, which is stored in the ROM 45 and defines a relationship between the data and the acceleration time.

FIG. 17 shows an example of a flow chart to decide the acceleration times for each motor 29. This procedure is executed during a startup procedure after the color printing apparatus 1 is turned on. First, the CPU 43 starts to rotate each motor 29 in turn and detects the acceleration time by the method mentioned above (S1). After that the CPU 43 compares the present acceleration time detected in the step S1 to the previous acceleration time stored in the NVRAM 47 (S2). If both acceleration times are same, then this procedure ends. However, if both acceleration times are different, then the CPU 43 replaces the previous acceleration time with the present acceleration time and stores the present acceleration time in the NVRAM 47 (S3). The CPU 43 determines the acceleration time every time the apparatus is turned on, and uses the acceleration time decided in the startup procedure to prevent the color registration difference in the first print in the color print mode. The load of the motors 29 changes because the mechanical conditions change as time passes, so if the acceleration time is fixed and not changed then the color registration difference changes when time passes. To prevent that problem, the CPU 43 detects the drive current of the motors 29 and replaces the acceleration time during the startup procedure.

First, the CPU 43 determines the print mode change for plural print jobs or for plural pages in one print job based on the print mode command from the external PC 100. If the print mode changes from the black and white print mode to the color print mode (S140), then the CPU 43 determines if the sensor 30Bk detects the filler 31Bk (S141)). If the sensor 30Bk detects the filler 31Bk, then the CPU 43 sets the timers for each color. In this embodiment, suppose the acceleration time for the motors 29Y, 29C and 29M is T2, T3 and T4 (T2<T3<T4). The CPU 43 determines if the offset time minus the acceleration time for the motor 29Y (Ta−T2) has passed or not (S142). If the time (Ta−T2) has passed, then the CPU 43 turns on the motor 29Y (S143). Then the CPU 43 determines if the offset time minus the acceleration time for the motor 29C (Ta−T3) has passed or not (S144). If the time (Ta−T3) has passed, then the CPU 43 turns on the motor 29C (S145). Then the CPU 43 determines if the offset time minus the acceleration time for the motor 29M (Ta−T4) has passed or not (S146). If the time (Ta−T4) has passed, then the CPU 43 turns on the motor 29M (S147).

In this embodiment, the color printing apparatus 1 detects the loads for the motors 29 automatically and sets the adjustment time for each motor 29 during the startup procedure. Thus, there is no need for inputting the acceleration time from the operational panel. Also, it prevents the color registration difference caused by the acceleration time change. If stepping motors are applied as the motors 29, this embodiment could be omitted.

What is claimed is:

1. A color printing apparatus, comprising:

a plurality of photosensitive drums each corresponding to a color, a plurality of motors corresponding to each photosensitive drum, an image forming unit configured to form an image with the photosensitive drums, a print mode setting unit configured to set a first print mode wherein the image forming unit forms the image with all photosensitive drums and a second print mode wherein the image forming unit forms the image with one of the photosensitive drums, while other photosensitive drums are stopped, a controller configured to control the motors to rotate all of the photosensitive drums, wherein if the first print mode occurs consecutively after the second print mode, then the controller controls the motor to continue to rotate the one of the photosensitive drums and starts to rotate the other photosensitive drums to satisfy a positional relationship which decreases fluctuations of rotating speed for each photosensitive drum.

2. A color printing apparatus according to claim 1, further comprising:

a home position detector for each photosensitive drum, a memory configured to store an offset time, wherein the controller controls rotations of the motors to satisfy the positional relationship by the offset time, which is the rotating time after the home position detector detects the home position of the photosensitive drum.

3. A color printing apparatus according to claim 2, wherein the controller turns on the motors to start rotation of other photosensitive drums when the home position detector detects the home position of the photosensitive drum which is used in the second print mode.

4. A color printing apparatus according to claim 3, wherein the controller turns off the motors to stop rotation of all photosensitive drums after predetermined time passes since the home position detector for the photosensitive drum which is used in the second mode detects the home position.

5. A color printing apparatus according to claim 4, wherein the predetermined time is variable.

6. A color printing apparatus according to claim 4, wherein the controller turns on the motors to start rotation of the other photosensitive drums when the predetermined time passes after the home position detector detects the home position of the photosensitive drum which is used in the second print mode.

7. A color printing apparatus according to claim 5, further comprising:

an acceleration time setting unit configured to set an acceleration time, which is a time from turning on the motor to when a rotation speed of the motor becomes a rated rotation speed, a second memory configured to store the acceleration time, wherein the controller turns on the motors to start rotation of the other photosensitive drums when the predetermined time minus an acceleration time passes after the home position detector detects the home position of the photosensitive drum which is used in the second print mode.

8. A color printing apparatus according to claim 5, further comprising:

an acceleration detecting unit configured to detect the acceleration time, wherein the acceleration times for each photosensitive drum are detected during a startup procedure after the color printing apparatus turned on.

9. A color printing apparatus according to claim 8, wherein the acceleration detecting unit detects the acceleration time by measuring a motor current.

10. A color printing apparatus according to claim 2, wherein the controller turns off the motor which is used in the second print mode to stop rotation of the photosensitive drum when the home position detector detects the home position of the photosensitive drum.

11. A color printing apparatus, comprising:

a plurality of photosensitive drums each corresponding to a color, a plurality of motors corresponding to each photosensitive drum, an image forming unit configured to form an image with the photosensitive drums, a print mode setting unit configured to set a first print mode wherein the image forming unit forms the image with all photosensitive drums and a second print mode wherein the image forming unit forms the image with one of the photosensitive drums, while other photosensitive drums are stopped, means for controlling the motors to rotate all of the photosensitive drums, wherein if the first print mode occurs consecutively after the second print mode, then the means for controlling controls the motor to continue to rotate the one of the photosensitive drums and starts to rotate the other photosensitive drums to satisfy a positional relationship which decreases fluctuations of rotating speed for each photosensitive drums.

12. A color printing apparatus according to claim 11, further comprising:

a home position detector for each photosensitive drum, a memory configured to store an offset time, wherein the means for controlling controls rotations of the motors to satisfy the positional relationship by the offset time, which is the rotating time after the home position detector detects the home position of the photosensitive drum.

13. A color printing apparatus according to claim 12, wherein the means for controlling turns on the motors to start rotation of other photosensitive drums when the home position detector detects the home position of the photosensitive drum which is used in the second print mode.

14. A color printing apparatus according to claim 13, wherein the means for controlling turns off the motors to stop rotation of all photosensitive drums after predetermined time passes since the home position detector for the photosensitive drum which is used in the second mode detects the home position.

15. A color printing apparatus according to claim 14, wherein the means for controlling turns on the motors to start rotation of the other photosensitive drums when the predetermined time passes after the home position detector detects the home position of the photosensitive drum which is used in the second print mode.

16. A color printing apparatus according to claim 15, further comprising:

an acceleration time setting unit configured to set an acceleration time, which is a time from turning on the motor to when a rotation speed of the motor becomes a rated rotation speed, a second memory configured to store the acceleration time, wherein the means for controlling turns on the motors to start rotation of the other photosensitive drums when the predetermined time minus an acceleration time passes after the home position detector detects the home position of the photosensitive drum which is used in the second print mode.

17. A color printing apparatus according to claim 12, wherein the means for controlling turns off the motor which is used in the second print mode to stop rotation of the photosensitive drum when the home position detector detects the home position of the photosensitive drum.

18. A method for controlling a color printing apparatus comprising:

detecting the positions of a plurality of photosensitive drums each corresponding to a color;

setting a print mode setting unit in a first print mode wherein an image forming unit forms an image with all photosensitive drums or a second print mode wherein the image forming unit forms an image with one of the photosensitive drums while other photosensitive drums are stopped;

continuing to rotate the one of the photosensitive drums and starting rotation of the other photosensitive drums to satisfy a positional relationship which decreases fluctuations of rotating speed for each photosensitive drum, if the first print mode occurs consecutively after the second print mode.

19. The method according to claim 18, further comprising:

controlling rotations of the photosensitive drums to satisfy the positional relationship by an offset time, which is a rotating time after a home position detector detects a home position of the photosensitive drum.

20. The method according to claim 18, further comprising:

starting rotation of other photosensitive drums when a home position detector detects a home position of the photosensitive drum which is used in the second print mode.

* * * * *